US006279842B1

(12) United States Patent
Spain

(10) Patent No.: US 6,279,842 B1
(45) Date of Patent: Aug. 28, 2001

(54) MAGNETOSTRICTIVELY ACTUATED FUEL INJECTOR

(75) Inventor: Byron Spain, Maple Valley, WA (US)

(73) Assignee: Rodi Power Systems, Inc., Puyallup, WA (US)

( * ) Notice: Subject to any disclaimer, the term of this patent is extended or adjusted under 35 U.S.C. 154(b) by 0 days.

(21) Appl. No.: 09/515,342

(22) Filed: Feb. 29, 2000

(51) Int. Cl.[7] ..... F02M 61/00

(52) U.S. Cl. ..... 239/585.1; 239/585.3; 239/585.4; 239/585.5; 239/102.2; 251/129.06

(58) Field of Search ..... 239/88, 92, 95, 239/533.2, 533.9, 585.1, 585.2, 585.3, 585.4, 585.5, 102.2; 251/129.06

(56) References Cited

U.S. PATENT DOCUMENTS

| | | | | |
|---|---|---|---|---|
| Re. 34,945 | | 5/1995 | Sayer et al. . | |
| 2,721,100 | * | 10/1955 | Bodine, Jr. | 239/102.2 |
| 4,782,794 | | 11/1988 | Hsu et al. . | |
| 4,946,103 | | 8/1990 | Ganser . | |
| 5,163,463 | | 11/1992 | Gassman et al. . | |
| 5,244,180 | | 9/1993 | Wakeman et al. . | |
| 5,280,773 | * | 1/1994 | Henkel | 123/467 |
| 5,381,817 | | 1/1995 | Gassman et al. . | |
| 5,501,425 | | 3/1996 | Reinicke et al. . | |
| 5,645,226 | | 7/1997 | Bright . | |
| 5,660,368 | | 8/1997 | De Matthaeis et al. . | |
| 5,719,791 | | 2/1998 | Neumeier et al. . | |
| 5,784,300 | | 7/1998 | Neumeier et al. . | |
| 5,820,101 | | 10/1998 | Ricco . | |
| 5,868,375 | | 2/1999 | Reinicke et al. . | |
| 5,892,315 | | 4/1999 | Gipson et al. . | |

* cited by examiner

*Primary Examiner*—David A. Scherbel
*Assistant Examiner*—Robin O. Evans
(74) *Attorney, Agent, or Firm*—Christensen O'Connor Johnson & Kindness PLLC

(57) ABSTRACT

Various embodiments of a fuel injector are provided for use in an internal combustion engine. Each embodiment uses an assembly that incorporates a magnetostrictive rod to extend and retract a needle to control fuel expulsion from the injector. In one embodiment, the fuel injector includes an actuation assembly and a nozzle assembly releasably connected thereto In another embodiment, the fuel injector includes a pintle-style needle tip. In yet other embodiments, the fuel injector includes a long-stem style needle tip.

24 Claims, 6 Drawing Sheets

MAGNETOSTRICTIVELY ACTUATED FUEL INJECTOR

FIELD OF THE INVENTION

The present invention relates to an electronically-controlled fuel injector for internal combustion engines, and more particularly to fuel injectors suited for the direct injection of high-pressure fuel into the combustion chamber of an internal combustion engine.

BACKGROUND OF THE INVENTION

Various types of fuel injectors are known for use with internal combustion engines. In one type, a low voltage solenoid coil is used in combination with an iron rod to restrict or enable fuel delivery from the injector tip. In another type, the fuel injector includes a piezoelectric component with is activated by a high voltage, low current across its surface to control fuel delivery. Piezoelectric injectors may be operated at high frequency which permits shaping of the fuel delivery profile.

Both of the above fuel injectors suffer from disadvantages. The solenoid/iron arrangement operates slowly. For example, their maximum cyclic capacity is approximately 1200 cycles per minute (cpm). While the piezo-electric device is much faster (e.g., approximately 6000 cpm), it is expensive to produce and has a limited life due to stresses produced within the piezoelectric components. Thus, a need exists for a high-pressure fuel injector for use with internal combustion engines where the fuel injector is capable of high cycles per minute and that is also long-lived. The present invention is directed to fulfilling these needs and others, as described below.

SUMMARY OF THE INVENTION

The present invention includes a unique fuel injector and its application in an internal combustion engine. Each embodiment uses an assembly that incorporates a magnetostrictive rod to extend and retract a needle to control fuel expulsion from the injector. In one embodiment, the fuel injector includes an actuation assembly and a nozzle assembly releasably connected thereto. In another embodiment, the fuel injector includes a pintle-style needle tip. In yet other embodiments, the fuel injector includes a long-stem style needle tip.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention includes a unique fuel injector and its application in an internal combustion engine, particularly engines having input fuel pressures in the range of about 2,000 psi to about 35,000 psi. The fuel injector takes advantage of the particular properties of magnetostrictive materials (e.g., Terfenol-D made by Etrema Products, Inc.) to extend and retract an injector needle in a longitudinal direction. Three embodiments of the invention are illustrated in the accompanying drawings. As will be appreciated, other arrangements are possible. In the first and second embodiments, the fuel injector includes separable components—an actuation assembly 10 and a nozzle assembly 12. This enables a user to easily replace only a portion of the injector, for example to switch injection heads and/or to replace worn components. In both the first and second embodiments, the injector body is substantially the same. In the third embodiment, the fuel injector is formed as a single unit.

Figure 1:
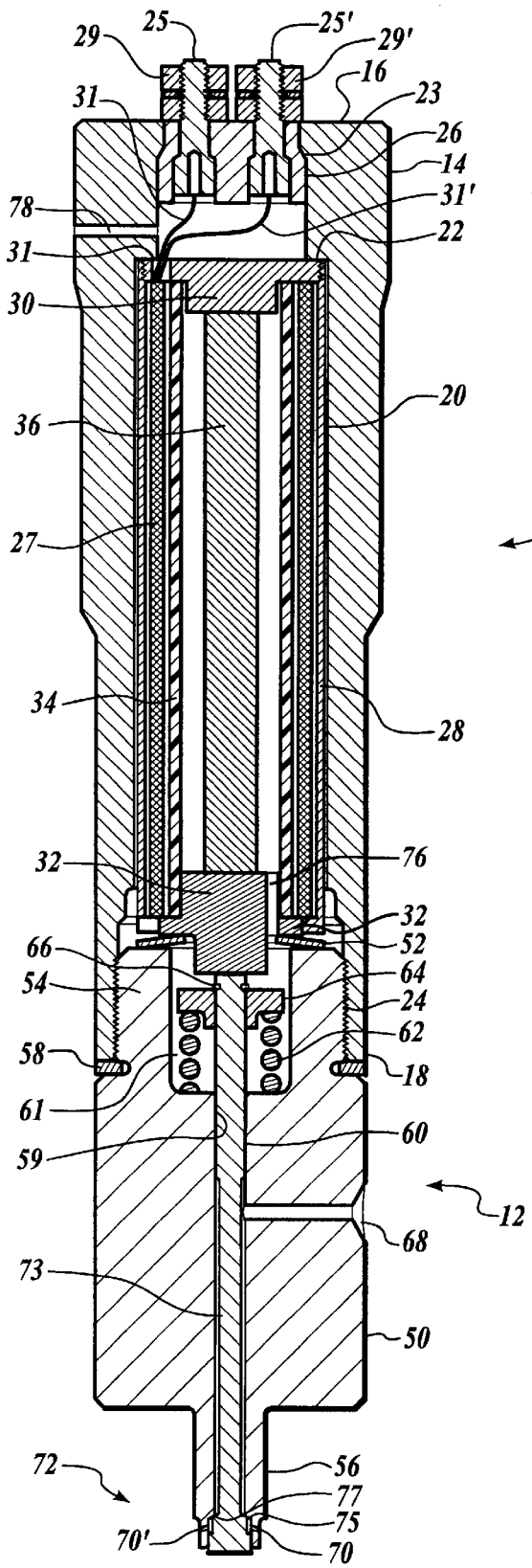
FIG. 1 is a cross-sectional side view of a first embodiment of a fuel injector formed in accordance with the present invention.

Referring to the first embodiment, shown in FIG. 1, the actuation assembly 10 includes a generally cylindrical elongate injector body 14 having a first end 16 and a second end 18. The injector body 14 further includes a longitudinal bore having a main section 20 defined by a bore shoulder 22 located near the body first end 16. Threads 24 are provided over a portion of the bore located near the body second end 18. Various electrical components are provided, including terminals 25, 25' formed in a plug 26 that is adapted to close off the bore opening at the injector body first end 16. In the embodiment of FIG. 1, this is done by use of a plug 26 capable of being seated upon a bevel 23 formed in the bore near the body first end 16. The plug 26 is held seated by washer nuts 29, 29' secured around the terminals 25 and 25'. A coil 27 is held within the injector body and is electrically connected to the terminals 25, 25' via insulated wires, 31, 31'. The plug 26 is preferably formed of a phenolic insulator material sealed to the body 14 with a sealant.

The actuation assembly 10 further includes an elongate cylindrical housing 28 sized to fit within the bore main section 20. The upper end of the housing abuts against the bore shoulder 22. The housing is formed of steel or other similar materials. The housing contains the coil 27, a magnetostrictive rod 36, and an insulator 34. The rod 36 is positioned within the coil 27, with the insulator 34 positioned therebetween. An epoxy seal may be used between the insulator 34 and the coil 27.

The upper end of the housing 28 is closed off by an end cap 30. Alternatively, the end cap may be integrally formed with the housing 28. As shown, a small hole 31 is available in the end cap to allow the conductive wires 31, 31' to extend from the terminals 25, 25' to the coil 27 positioned within the housing 28. The wires 31, 31' are electrically connected to the terminals, such as by soldering. The lower end of the housing is closed off by an output rod 32. In the embodiment shown in FIG. 1, operative forces are transmitted directly between the output rod 32 and the magnetostrictive rod 36 during use.

Still referring to FIG. 1, the nozzle assembly 12 includes a nozzle body 50 having a first end 54 and a second end 56. The first end 54 includes exterior threads adapted to engage the bore threads 24 of the injector body second end 18. A seal 58 may be used, or other shim material, e.g., an annealed copper ring, to ensure the proper placement and seal of the nozzle body 50 relative to the actuation assembly 10. A rod-biasing spring 52 is disposed between the uppermost surface of the nozzle body and the output rod 32. In the embodiment shown in FIG. 1, the rod biasing spring 52 is a Belleville, or disc, spring. The force of the nozzle body 50, when threaded into the injector body second end 18, compresses the rod-biasing spring 52 against the output rod 32. This arrangement provides a constant compressive force against the magnetostrictive rod 36. Depending on the application, a designer should verify that the combination of nozzle body 50, rod biasing spring 52, and actuation assembly will continue to apply compression to the magnetostrictive rod throughout its operative cycle. In one embodiment, the Belleville spring provides a preloading force of about 250 lbs. In another embodiment, force is provided sufficient to compress the rod 36 a distance in the range of about 0.002 inches to about 0.0025 inches.

The nozzle body 50 further includes a longitudinal hole 59 and a concentric, larger-diameter cavity 61 located near the nozzle body first end 54. An injection needle 60 is held within the longitudinal hole 59 and is biased in an upward direction by a spring 62 located within the cavity 61. The spring pushes against a spring retainer 64 attached to the upper end of the needle 60 by a retainer clip 66.

A fuel input port 68 is available to receive high pressure fuel from a fuel pump. A pintle-style nozzle tip 72 includes fuel expulsion holes 70, 70'. A portion 73 of the needle 60 has a diameter that is appreciably less than the adjacent diameter of the longitudinal hole 59. The fuel input port 68 connects to this region of the needle so that fuel may flow around needle portion 73 during use. The lower end of the nozzle tip includes fuel expulsion hole(s) 70. A constricting bevel 75 is formed in the hole 59 near the tip holes 70. The needle 60 includes a shoulder 77 sized to mate with the constricting bevel 75. In the retracted position, the contact between the bevel 75 and shoulder 77 prohibits fuel flow from the holes 70. In the extended position, fuel passes between the bevel and shoulder to exit the tip 72. This is similar to pintle-style configurations, however, with the needle arranged to move downward to open.

During use, the spring 62 pushes against the needle retainer 64 to push the needle 60 upward against the output rod 32. This lifts the needle lower end shoulder 77 to contact the constricting bevel 75 to block fuel from flowing out the holes 70'. Upon application of electricity to the coil 27, a magnetic field is created which causes the magnetostrictive rod 36 to expand against the output rod 32. This further causes compression of the rod biasing spring 52 and downward motion of the needle 60. Downward motion of the needle 60 separates the needle lower end from the body hole 59, thereby allowing high-pressure fuel to pass out the fuel expulsion holes 70. In one embodiment, expansion and contraction distance of the rod 60 is in the range of about 0.0005 to about 0.003, a preferred amount being about 0.001 inches.

The embodiment of FIG. 1 includes provision to allow high-pressure fuel to leak, in small amounts, out of the nozzle body 50, into the actuation assembly 10, and out of the actuation assembly 10 to a collection area. This fuel helps to cool injector components. In more detail, fuel is allowed to pass in small quantity up the needle 60 into the cavity 61. From there, fuel can pass through a small hole 76 in the output rod 32, move through the housing 28 and out the housing upper hole 31. Fuel moving through the housing 28 is thus available to cool the coil 27 and the magnetostrictive rod 36. Fuel exits the injector body first end 16 through a fuel drain passage 78. Other arrangements may be used should a designer want to avoid fuel leakage or provide alternative means of cooling.

Figure 2A:
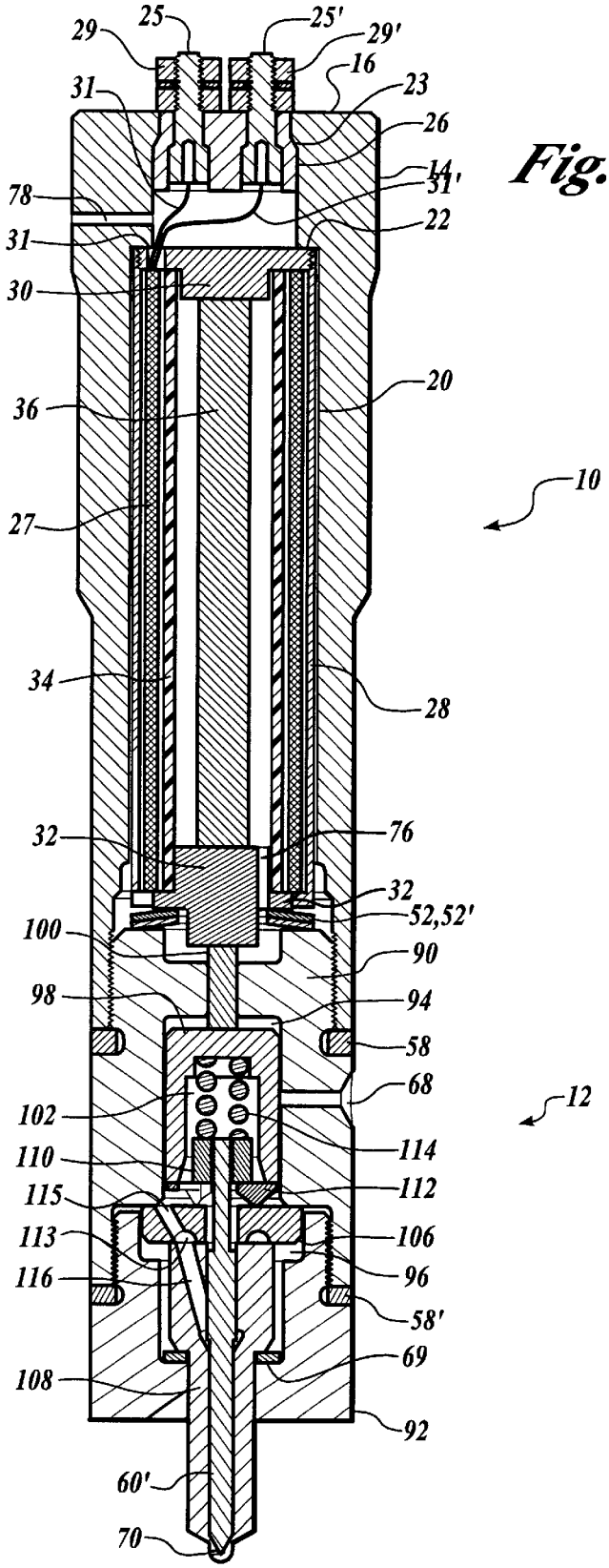
FIG. 2A is a cross-sectional side view of a second embodiment of a fuel injector formed in accordance with the present invention.

Referring to FIG. 2A, a second embodiment of a fuel injector formed in accordance with the present invention is provided. The embodiment of FIG. 2A is a "Bosch" style needle nozzle, or more generically, a long-stem hole style nozzle. As with the first embodiment, the nozzle assembly 12 of FIG. 2A is connected to the injector body second end 18. A rod-biasing spring 52 (e.g., a Belleville spring) is shown disposed therebetween. As shown, two springs 52 and 52' may be used for additional compressive strength. Seals 58, or shims, seal the seam between the injector body 14 and the nozzle assembly 12.

Unlike the pintle-style nozzle assembly of FIG. 1, the Bosch-style nozzle assembly of FIG. 2A requires components to bias a needle 60' in a downward direction. This is accomplished using a nozzle assembly having a first portion 90 and a second lower portion 92. The second portion 92 is connected to the lower end of the first portion 90 in a manner similar to the connection of the first portion 90 with the injector body second end 18. The first portion 90 includes a cavity 94 opening downward. The second portion 92 also includes a cavity 96, though opening upward. As assembled, the cavities 94 and 96 are adjacent to one another.

Still referring to FIG. 2A, a plunger 98 is disposed within the first portion 90. A plunger pin 100 extends longitudinally within the first portion 90 to transmit loads between the plunger 98 and the lower surface of the output rod 32. The plunger 98 has an internal space 102 that extends from the lowermost surface of the plunger 98 up into the plunger body a distance. The second portion 92 includes a trap 106 supported by a needle case 108. The trap 106 is disposed substantially within the second portion cavity 96. The needle case 108 is partially disposed within the cavity 96 and partially extended out the second portion 92 lower end. The needle 60' is held within the needle case 108 and further extends up through the trap 106 and into the internal space 102 of the plunger 98. A needle retainer such as nut 110 is connected to the upper end of the needle 60' within the internal space 102.

Figure 2B:
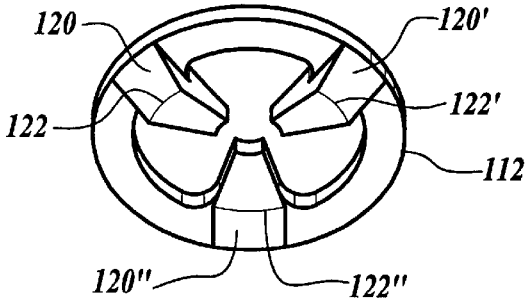
FIG. 2B is a perspective view of the radial spring shown in FIG. 2A.

Positioned between the lowermost surface of the plunger 98 and the uppermost surface of the trap 106 is a ring spring 112 (referred to herein generically as a radial spring). Referring to FIG. 2B, the ring spring 112 has a flat upper surface and a flat lower surface. Extending downward from the lower surface are a number of rocker arms 120, 120', 120". The rocker arms extend toward the center of the ring spring. Each rocker arm includes a line of pivot 122, 122', 122" on its underside. The radial, or ring spring, arrangement allows for relative motion between its circumference and the interior portion of each rocker arm.

Referring back to FIG. 2A, an opening in the center of the ring spring 112 allows the needle 60' to extend through the ring spring and allows the nut 110 to rest on the upper surface of the ring spring 112. A needle-biasing spring 114 is held in compression between the nut 110 and the uppermost surface of the plunger internal space 102.

A fuel expulsion opening 70 is formed in the lowermost end of the nozzle case 108 as is conventional in Bosch-style needle tips. A fuel input port 68 is provided in the first portion 90. High pressure fuel reaches the fuel expulsion hole 70 by passing from the input port 68 through the first portion cavity 94. The trap 106 includes a circular groove 113 on its underside and a passage 115 extending through the trap to the groove 113. The passage and groove allow fuel to travel through the trap to reach the interior of the needle case 108 in the spaces surrounding the needle 60'.

During use, the output rod 32 is biased upward against the magnetostrictive rod 36 by the compression in rod-biasing springs 52, 52'. The lower surface of the plunger rests against the ring spring upper perimental surface. The plunger is pressed against the plunger pin 100 at the plunger upper surface, while the needle retaining spring 114 pushes the nut 110 and needle 60' downward against the inner radial portions of the ring spring arms. The pivot points 122, 122', and 122", rest against the upper surface of the trap 106.

Upon application of electricity to the coil 27, the magnetostrictive rod 36 expands slightly to push the output rod 32 downward against the pin 100 which in turn pushes against the plunger 98. The lower surface of plunger 98 pushes on the upper outer edge of the spring 112 causing pivotal motion of the ring spring 112 to lift the nut 110 against the bias of the needle-biasing spring 114. Movement of the nut 110 causes corresponding upward movement of the needle 60' and corresponding opening of the fuel expulsion hole 70. Internal fuel flow up through the injector is possible as provided in the first embodiment. A seal 69 prohibits fuel leakage between the needle case 108 and the nozzle body lower portion 92.

Figure 2C:
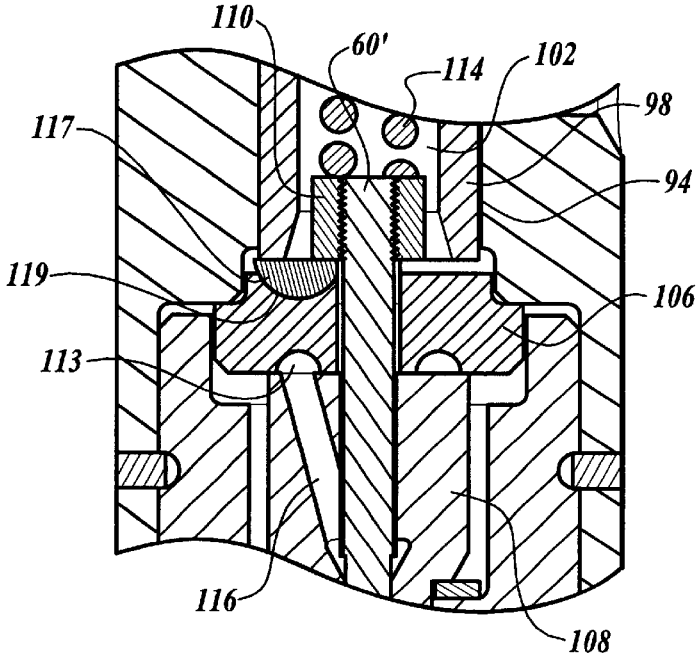
FIG. 2C is a cross-sectional side detail view of an alternative embodiment of the radial spring shown in FIG. 2A.
Figure 2D:
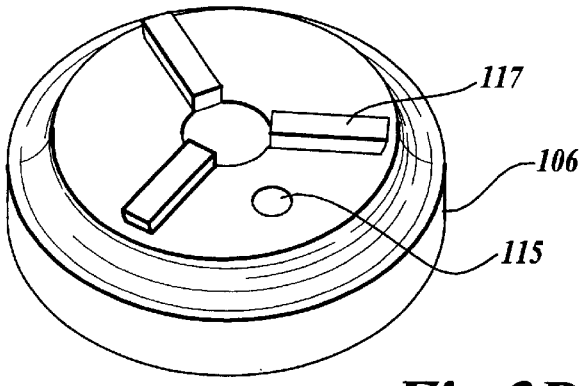
FIG. 2D is a perspective view of the arrangement shown in FIG. 2C.

FIGS. 2C and 2D illustrate an alternative embodiment of a radial spring. In FIG. 2C, the trap 106 is thicker and includes a number of arcuate troughs 119 extending into the trap upper surface and positioned radially therein at equal angular distances. See FIG. 2D. A key 117 is placed in each trough 119. Each key includes a flat upper surface and an arcuate lower surface sized to mate with its corresponding trough 119. During use, the plunger lower surface pushes against the outer end of the keys. The keys, in turn, rotate within their troughs causing the keys' inner end to push upward on the nut 110. This action thereby lifts the needle 60' and permits expulsion of fuel.

Figure 3A:
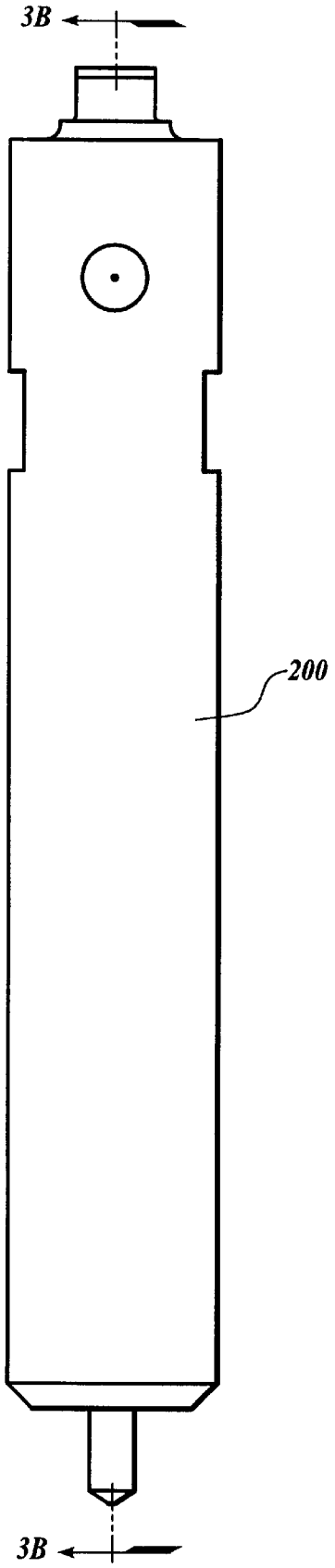
FIG. 3A is an elevational side view of a third embodiment of a fuel injector formed in accordance with the present invention.
Figure 3B:
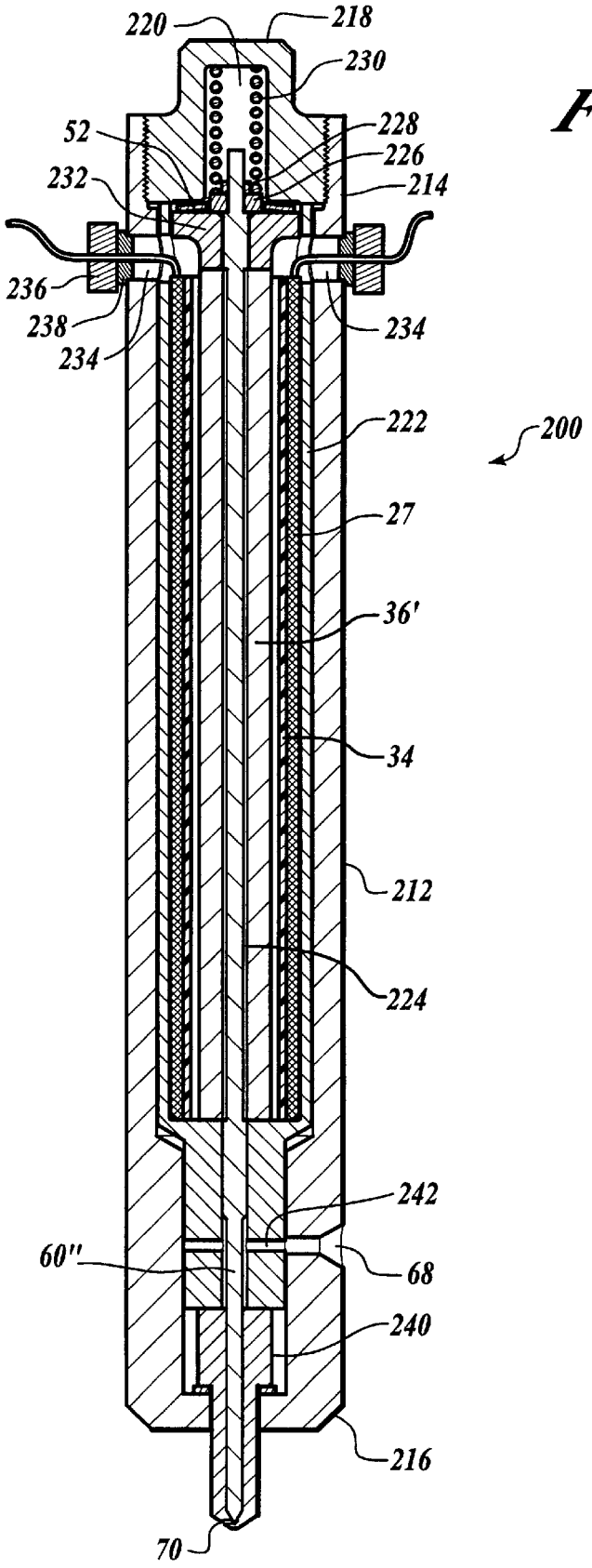
FIG. 3B is a cross-sectional side view of the third embodiment of a fuel injector formed in accordance with the present invention.

A third embodiment of a fuel injector formed in accordance with the present invention is provided in FIG. 3A in which an injector includes a combined actuation and nozzle assembly 200. As shown in FIG. 3B, the assembly 200 includes a housing 212 with a first end 214 and a second end 216. As in the prior arrangements, the injector housing 212 includes a longitudinal bore. An injector cap 218 closes off the bore at the housing first end 214. The injector cap includes cavity 220 extending partway into the injector cap from the undersurface thereof.

An actuation container 222 is formed as an elongate cylinder and is held within the housing 212. Within the actuation container 222, a coil 27, an insulator 34, and a magnetostrictive rod 36' are contained. The magnetostrictive rod 36' of FIG. 3B includes an inner passage 224. An elongate needle 60" is located within the inner passage 224. The needle upper end extends out the magnetostrictive rod 36' and up into the cavity 220 of the injector cap 218. A retainer 226 is attached to the upper end of the needle 60' and is held in place by a retainer clip 228. An output rod 232 is positioned between the uppermost end of the magnetostrictive rod 36' and the lower surface of the retainer 226. A Belleville spring or other rod-biasing spring 52 is compressed between the upper surface of the output rod 232 and the lower surface of the injector cap 218, with the needle 60" extending up through the magnetostrictive rod 36' and through the center of the output rod 232. A needle-biasing spring 230 is held in compression within the injector cap. The spring 230 presses between the cap and a retainer nut that is attached to the first end of the elongate needle. The combination presses downward against the output rod.

Electric current is provided by wires that are placed through side openings 234 formed in the housing 212 and through the actuation container 222. Fittings 236 with seals 238 close off the side openings 234.

A needle case 240 is located below the lower end of the actuation container 222. The needle case 240 extends out the bottom of the housing 212. A high-pressure fuel input port 68 is formed in the housing 212 and connects with an input line 242 formed in the lower portion of the actuation container 222. The needle 60" at this location is of a smaller diameter than elsewhere. This allows high pressure fluid to travel around the needle 60' and downward to a fuel expulsion hole 70.

During use, application of electric current to the coil 27 causes the magnetostrictive rod 36' to overcome a portion of the compressive force provided from the Belleville spring 52 acting on the output rod 232 and against the upper end of the magnetostrictive rod 36'. The expansion of the rod 36' moves the output rod upward and in doing so further moves the retainer 226 upward. This causes the needle 60' to lift and allow high pressure fluid to exit the expulsion hole 70.

Figure 4:
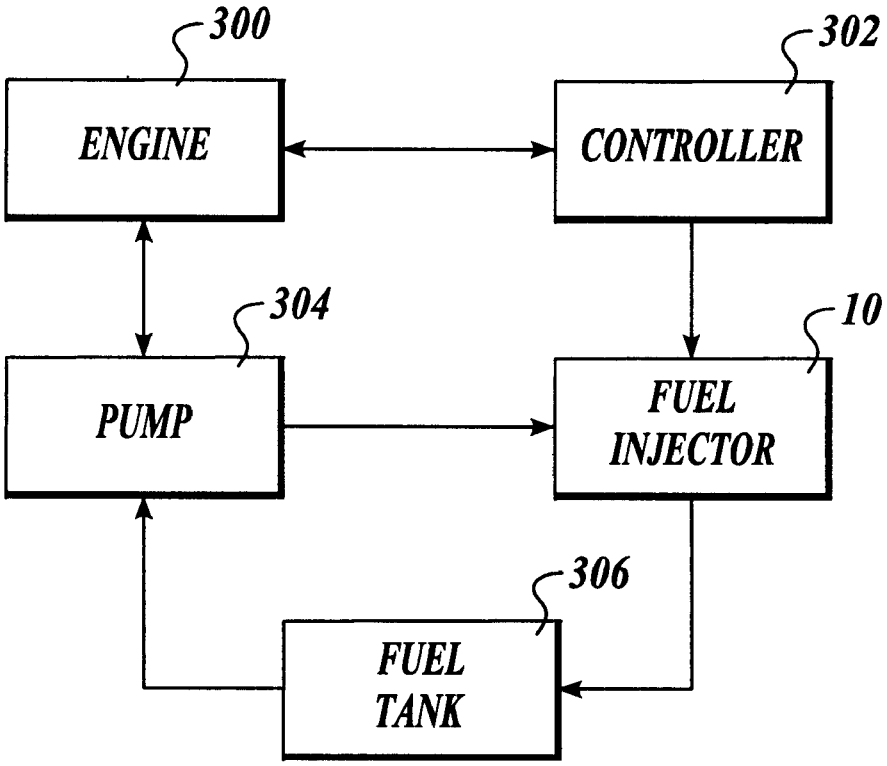
FIG. 4 is a schematic system diagram illustrating an arrangement of a fuel injector in an internal combustion engine system.

FIG. 4 is a schematic illustration of an internal combustion engine system formed in accordance with the present invention, including the use of a fuel injector such as described above. The engine 300 is in communication with a controller 302 and a fuel pump 304. The pump provides high pressure fuel from a fuel tank 306 to the fuel injector 10 while the controller 302 provides timed voltage to activate the coil of the fuel injector 10.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A fuel injector for use in an internal combustion engine, the fuel injector comprising:

(a) an actuation assembly including an elongate injector body having a first end, a second end, and a longitudinal bore; a housing having open first and second ends, an end cap closing off the housing first end; an electrically conductive coil, a magnetostrictive rod, and an insulator, the rod being positioned within the insulator, the insulator being positioned within the coil, the coil being positioned within the housing, and the housing being positioned within the body longitudinal bore; electrical components adapted to bring electric current into the housing and to the conductive coil; an output rod located at the housing second end and in direct contact with the magnetostrictive rod; and a rod-biasing spring; and (b) a nozzle assembly including a nozzle body with first and second ends, a needle having first and second ends, fuel expulsion holes formed in the nozzle body second end, and components to bias the needle in an specific direction within the nozzle body; and a fuel input port and passage being formed in the nozzle body and adapted to direct high pressure fuel to the fuel expulsion holes;

wherein the nozzle body first end is releasably connected to the injector body second end and the rod-biasing spring is positioned to compress the magnetostrictive rod when the nozzle body and injector body are so connected; and wherein during use, application of electric current to the coil causes expansion of the magnetostrictive rod against the output rod and the rod-biasing spring; in doing so, the output rod further moves the needle and the components that are biasing the needle such that the fuel expulsion holes are opened, thus allowing high pressure fuel to exit the nozzle body.

2. The fuel injector according to claim 1, wherein the releasable connection includes mating threads formed in the second end of the injector body and the first end of the nozzle body.

3. The fuel injector according to claim 1, wherein the arrangement of the nozzle assembly, the injector assembly, and the rod-biasing spring provides a compressive force on the magnetostrictive rod in the range of about 1400 psi to about 2100 psi.

4. The fuel injector according to claim 1, wherein the connection between the nozzle assembly and the injector assembly compresses the magnetostrictive rod an amount in the range of about 0.002 inches to about 0.0025 inches.

5. The fuel injector according to claim 1, wherein the rod-biasing spring is a disc spring.

6. The fuel injector according to claim 1, wherein the nozzle assembly includes a pintle-style nozzle tip and components bias the needle in an upward direction within the nozzle body.

7. The fuel injector according to claim 1, wherein the nozzle assembly includes a long-stem style nozzle tip and components bias the needle in a downward direction within the nozzle body.

8. A fuel injector for use in an internal combustion engine, the fuel injector comprising:

(a) an actuation assembly including an elongate injector body having a first end, a second end, and a longitudinal bore; a housing having open first and second ends, an end cap closing off the housing first end; an electrically conductive coil, a magnetostrictive rod, and an insulator, the rod being positioned within the insulator, the insulator being positioned within the coil, the coil being positioned within the housing, and the housing being positioned within the body longitudinal bore; electrical components adapted to bring electric current into the housing and to the conductive coil; and an output rod located at the housing second end and in direct contact with the magnetostrictive rod; and a rod-biasing spring; and (b) a nozzle assembly including a nozzle body with first and second ends, a needle having first and second ends, components to bias the needle in an upward direction within the nozzle body, fuel expulsion holes formed in the nozzle body second end, and a fuel input port and passage formed in the nozzle body and adapted to direct high pressure fuel to the fuel expulsion holes;

wherein the nozzle body first end is connected to the actuation assembly second end, the rod-biasing spring being positioned to compress the magnetostrictive rod when the nozzle body and injector body are so connected; and the needle fit end contacts the output rod;

wherein during use, application of electric current to the coil causes expansion of the magnetostrictive rod against the output rod and the rod-biasing spring; in doing so, the output rod further pushes against the needle thus overcoming the components biasing the needle in the upward direction and causing the needle to move longitudinally downward; downward motion of the needle second end allowing high pressure fuel to exit fuel expulsion holes in the nozzle body second end.

9. The fuel injector according to claim 8, wherein the connection between the nozzle body and the injector body is a releasable connection using mating threads formed in the second end of the injector body and the first end of the nozzle body.

10. The fuel injector according to claim 8, wherein the rod-biasing spring is a disc spring.

11. The fuel injector according to claim 8, wherein the needle second end is formed as a pintle-style injector tip.

12. The fuel injector according to claim 8, wherein the nozzle body first end includes a cavity and the components to bias the needle in an upward direction include a retainer affixed to the needle near the needle first end and a spring; the needle first end being positioned within the cavity and in direct contact with the output rod, the spring being held in compression within the cavity below the retainer; the compression of the spring pushing upward against the retainer to correspondingly push the needle first end toward the output rod.

13. A fuel injector for use in an internal combustion engine, the fuel injector comprising:

(a) an actuation assembly including an elongate injector body having a first end, a second end, and a longitudinal bore; a housing having open first and second ends, an end cap closing off the housing first end; an electrically conductive coil, a magnetostrictive rod, and an insulator, the rod being positioned within the insulator, the insulator being positioned within the coil, the coil being positioned within the housing, and the housing being positioned within the body longitudinal bore; electrical components adapted to bring electric current into the housing and to the conductive coil; and an output rod located at the housing second end and in direct contact with the magnetostrictive rod; and a rod-biasing spring; and (b) a nozzle assembly including a nozzle body with fit and second ends, a needle having first and second ends, components to bias the needle in a downward direction within the nozzle body, fuel expulsion holes formed in the nozzle body second end, and a fuel input port and passage formed in the nozzle body and adapted to direct high pressure fuel to the fuel expulsion holes;

wherein the nozzle body first end is connected to the actuation assembly second end, the rod-biasing spring being positioned to compress the magnetostrictive rod when the nozzle body and injector body are so connected; and the needle first end contacts the output rod;

wherein during use, application of electric current to the coil causes expansion of the magnetostrictive rod against the output rod and the rod-biasing spring; in doing so, the output rod further pushes against the needle thus overcoming the components biasing the needle in the downward direction and causing the needle to move longitudinally upward; upward motion of the needle second end allowing high pressure fuel to exit fuel expulsion holes in the nozzle body second end.

14. The fuel injector according to claim 13, wherein the connection between the nozzle body and the injector body is a releasable connection using mating threads formed in the second end of the injector body and the first end of the nozzle body.

15. The fuel injector according to claim 13, wherein the rod-biasing spring is a disc spring.

16. The fuel injector according to claim 13, wherein the needle second end is formed as a long-stem style injector tip.

17. The fuel injector according to claim 13, wherein the nozzle body includes:

(a) a first portion having a cavity formed in its lower surface, a second portion having a cavity formed in its upper surface, the first and second portions being connected to one another such that their cavities are adjacent;

(b) a plunger having a cavity in its underside, a spring located within the plunger cavity, and a upper plunger rod; the plunger and spring being positioned within the nozzle body first portion with the plunger rod contacting the output rod of the actuator assembly;

(c) a trap and a needle case positioned below the trap, the trap and needle case being held within the nozzle body second portion with the needle extending therethrough and into the plunger cavity; a retaining nut attached to the upper end of the needle; and (d) a radial spring located between the plunger and the trap; the needle also extending up through the radial spring with the retaining nut resting on the radial spring upper surface; the plunger spring being held in compression and pushing downward against the needle via the retaining nut;

wherein during application of electric current the output rod pushes against the plunger rod which pivots the radial spring and in doing so pushes the retaining nut and needle upward to overcome the plunger spring that is biasing the needle in the downward direction; the upward movement of the needle allowing high pressure fuel to exit fuel expulsion holes in the nozzle body second end.

18. The fuel injector according to claim 13, wherein the nozzle body includes:

(a) a first portion having a cavity formed in its lower surface, a second portion having a cavity formed in its upper surface, the first and second portions being connected to one another such that their cavities are adjacent;

(b) a plunger having a cavity in its underside, a spring located within the plunger cavity, and a upper plunger rod; the plunger and spring being positioned within the nozzle body first portion with the plunger rod contacting the output rod of the actuator assembly;

(c) a trap and a needle case positioned below the trap, the trap and needle case being held within the nozzle body second portion with the needle extending therethrough and into the plunger cavity; a retaining nut attached to the upper end of the needle; and (d) a number of keys rotatably connected to the upper surface of the trap and located between the plunger and the trap; each key having an upper surface, an outer radial end, and an inner radial end; the needle retaining nut resting on the inner radial ends of the keys' upper surface; the plunger spring being held in compression and pushing downward against the needle via the retaining nut;

wherein during application of electric current the output rod pushes against the plunger rod which pushes downward on the outer radial ends of the number of keys and in doing so causes the keys to rotate within their connection to the traps, the key inner ends thereby pushing the retaining nut and needle upward to overcome the plunger spring that is biasing the needle in the downward direction; the upward movement of the needle allowing high pressure fuel to exit fuel expulsion holes in the nozzle body second end.

19. A fuel injector for use in an internal combustion engine, the fuel injector comprising:

(a) an elongate housing having a first end, a second end, a longitudinal bore extending therebetween, fuel expulsion holes located at the housing second end, and a fuel input port and passage formed in the housing and adapted to direct high pressure fuel to the fuel expulsion holes; an injector cap having a lower surface cavity; the injector cap closing off the housing fist end;

(b) an actuation container, an electrically conductive coil, a magnetostrictive rod, an insulator, and an elongate needle having first and second ends; the elongate needle extending through the magnetostrictive rod, the rod being positioned within the insulator, the insulator being positioned within the coil, the coil being positioned within the container, and the container being positioned within the housing longitudinal bore; electrical components adapted to bring electric current into the container and to the conductive coil;

(c) an output rod located at the container first end and in direct contact with the upper surface of the magnetostrictive rod;

(d) a rod-biasing spring held in compression between the injector cap and the output rod; the rod-biasing spring providing sufficient compressive force to compress the magnetostrictive rod;

(e) a needle-biasing spring held in compression in the injector cap lower surface cavity and pressing against a retainer nut attached to the first end of the elongate needle, the retainer nut pressing downward against the output rod;

wherein during use, application of electric current to the coil causes expansion of the magnetostrictive rod upward against the output rod and the rod-biasing spring; in doing so, the output rod further pushes against the needle retainer nut thus overcoming the compressive force of the needle-biasing spring in the cavity and causing the needle to move longitudinally upward; upward motion of the needle second end allowing high pressure fuel to exit fuel expulsion holes in the nozzle body second end.

20. The fuel injector according to claim 19, wherein the arrangement of the injector cap, the output rod, and the rod-biasing spring provides a compressive force on the magnetostrictive rod in the range of about 1400 psi to about 2100 psi.

21. The fuel injector according to claim 19, wherein the positioning of the injector cap and the output rod compressed the magnetostrictive rod an amount in the range of about 0.002 inches to about 0.0025 inches.

22. The fuel injector according to claim 19, wherein the rod-biasing spring is a disc spring.

23. The fuel injector according to claim 19, wherein the needle second end is formed as a long-stem style injector tip.

24. The fuel injector according to claim 19, wherein the magnetostrictive rod extends and compresses by an amount in the range of about 0.002 inches to about 0.006 inches.

* * * * *